US005535685A

United States Patent [19]

Choi

[11] Patent Number: 5,535,685

[45] Date of Patent: Jul. 16, 1996

[54] INCINERATOR UTILIZING DRY DISTILLATION

[75] Inventor: Mu-Hung Choi, Pusan, Rep. of Korea

[73] Assignee: Dae Hwan Co., Ltd., Taegu, Rep. of Korea

[21] Appl. No.: 365,120

[22] Filed: Dec. 28, 1994

[51] Int. Cl.[6] ..... F23G 5/02

[52] U.S. Cl. ..... 110/223; 110/229; 110/224; 110/251; 110/215

[58] Field of Search ..... 110/223, 224, 110/229, 215, 229, 251

[56] References Cited

U.S. PATENT DOCUMENTS

| | | | |
|---|---|---|---|
| 4,350,102 | 9/1982 | Ruegg . | |
| 4,361,100 | 11/1982 | Hinger | 110/110 |
| 4,510,892 | 4/1985 | Wincze et al. . | |
| 4,554,876 | 11/1985 | Grachtrup . | |
| 4,748,918 | 6/1988 | Chang . | |
| 4,768,445 | 9/1988 | Vollhardt et al. . | |
| 4,829,911 | 5/1989 | Nieson | 110/229 |
| 4,878,440 | 11/1989 | Tratz et al. | 110/229 |
| 5,230,292 | 7/1993 | Workman et al. | 110/210 |
| 5,295,449 | 3/1994 | Maeda et al. | 110/229 |

FOREIGN PATENT DOCUMENTS

| | | | |
|---|---|---|---|
| 2669099 | 5/1992 | France | 110/229 |

*Primary Examiner*—Thomas E. Denion

*Attorney, Agent, or Firm*—Oblon, Spivak, McClelland, Maier & Neustadt

[57] ABSTRACT

An incinerator for carrying out incineration of general or specific waste dry distillation, which can improve wastes incineration efficiency and prevent secondary pollution, such as a gas smell, by performing complete combustion by facilitating feeding of waste and discharging of ash under a condition that the furnace maintained sealed like for a conventional dry distillation incineration furnace. The incinerator is provided to feed waste introduced into a waste placing tube to a dry distillation incineration furnace by repeatedly pressing the waste, to discharge ash heaped on the bottom of the dry distillation incineration furnace by dropping into an ash placing tube with a discharge blade and pressing the dropped ash with a pressing plate, and to incinerate specific waste with high moist contents and waste wire using an indirect dry distillation tank accommodated in a combustion tank. The incinerator is also provided to facilitate complete combustion by multiple combustion of the distilled gas for preventing secondary pollution.

22 Claims, 8 Drawing Sheets

INCINERATOR UTILIZING DRY DISTILLATION

BACKGROUND OF THE INVENTION

1. Field of the Invention

This invention relates to an incinerator for carrying out incineration of general or specific wastes by dry distillation.

2. Description of the Prior Art

Incinerators are classified into two kinds depending on incineration method of wastes of direct burning type and dry distillation type.

The direct burning type incinerator that carries out incineration by direct burning of waste with air and heat supplied into a furnace to burn waste by flames, has been widely used because of the short incineration period of time required.

Incineration of waste with the direct burning type incinerator has problems in that the incinerator can hardly perform complete combustion of the waste, especially of waste with high moisture contents and in that the incinerator generates much soot, smell, and dust, and consequently in that the incinerator inevitably requires additional anti-pollution installations such as a dust collector.

Moreover, recently, in order to solve the problems of the foregoing direct burning type incinerator, the dry distillation type incinerator that incinerates waste with dry distillation wherein air and heat is supplied into the furnace at a rate which can burn the waste without flames being used. As incineration with the dry distillation type incinerator is to convert waste into flammable gas which is burned in a combustion chamber, it is possible to perform complete combustion of waste even with high moisture content and can prevent secondary pollution caused by soot, smell, and dust, and has advantages of utilizing the abundant heat from combustion of waste for the producing hot water and electricity.

However, since the dry distillation type incinerator has, like the direct burning type incinerator, to have the wastes introduced into the furnace in a batch in an initial stage of operation, and since the operation has to be stopped and delayed until the furnace naturally cools down after completion of the combustion of waste introduced into the furnace in the batch for manual taking out of the ash and introducing new waste into the furnace again because there is no fire ash discharge device, the dry distillation type incinerator requires a fairly long period of time for burning one batch of waste and, therefore, can not carry out an effective incineration.

SUMMARY OF THE INVENTION

The object of this invention is to solve the foregoing problems.

These and other objects and features of this invention can be achieved by providing an incinerator including a waste feeding device for press feeding waste introduced into a tube to a feed objective place by repeatedly pressing the waste, a dry distillation incineration device for carrying out dry distillation incineration of waste fed into a sealed dry distillation incineration furnace by the waste feeding device by supplying predetermined heat and air to the waste, an ash discharge device for automatic discharge of ash produced in the dry distillation incineration furnace, a dry distillation gas combustion device for burning dry distilled gas generated in the dry distillation incineration device, and an indirect dry distillation incineration tank for carrying out dry distillation incineration of waste wire and specific waste having high moisture contents remaining in the dry distillation incineration device.

DESCRIPTION OF THE PREFERRED EMBODIMENTS

Figure 1:
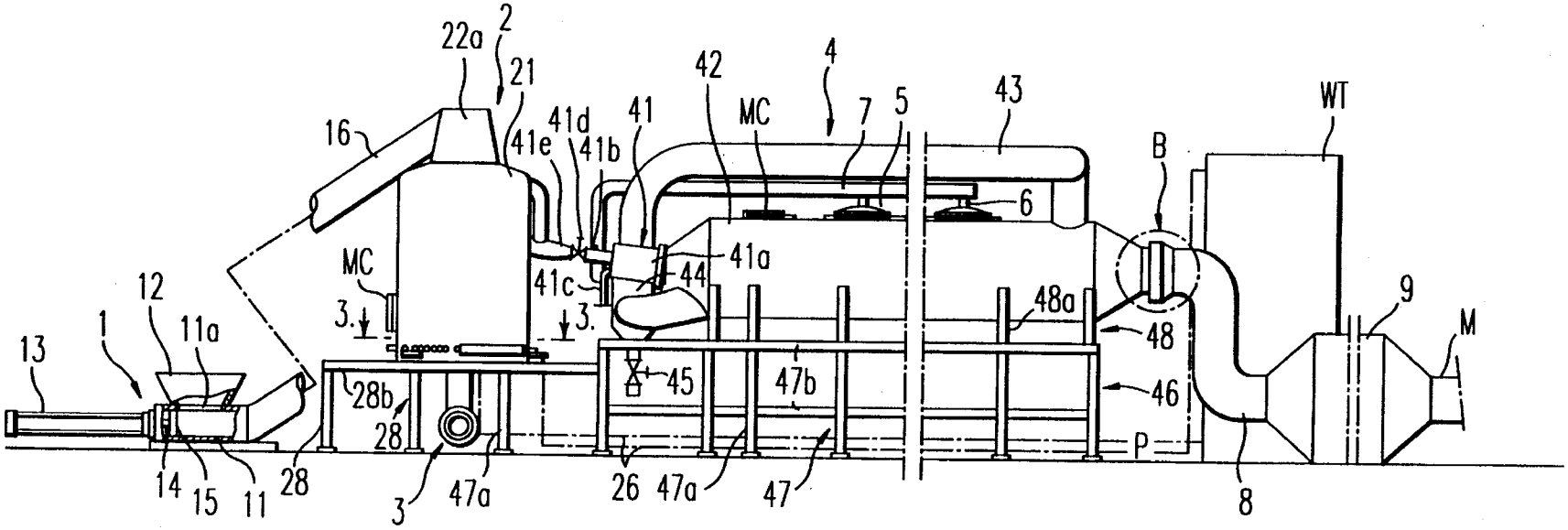
FIG. 1 is a front view of an incinerator in accordance with this invention.
Figure 2:
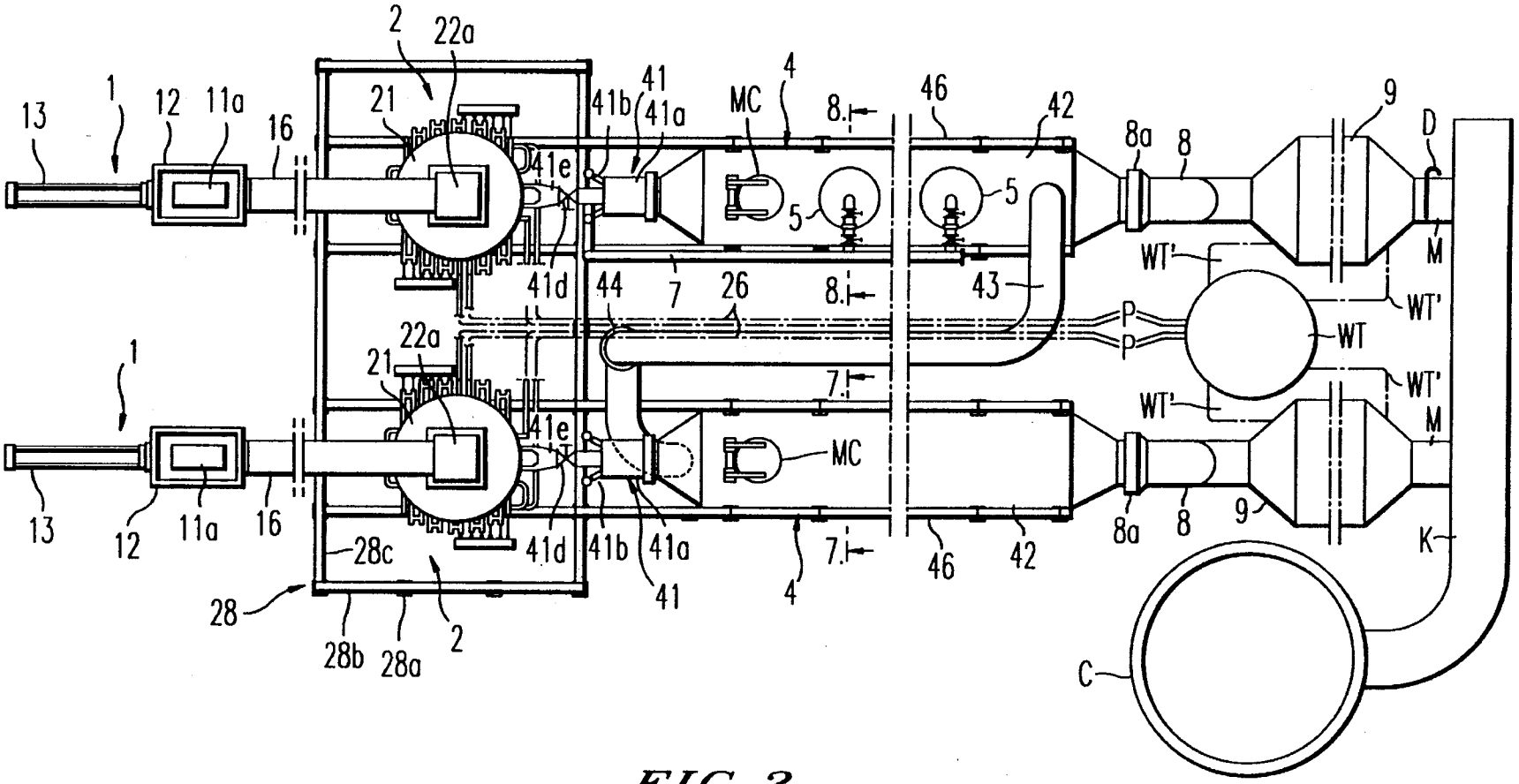
FIG. 2 is a plan view of the incinerator of FIG. 1.

An embodiment of this invention is to be explained hereinafter, referring to the attached drawings.

Reference numbers 1 indicate waste feeding devices installed so as to be parallely spaced a predetermined distance apart for repeatedly pressing waste to feed the waste to a feeding objective place, each including a hopper 12 provided on top of a waste introduction opening 11*a* formed on top of a waste transfer tube 11, a cylinder 13 provided at one side of the waste transfer tube 11, and a pressing plate 15 fixed at the fore end of a piston rod 14 coupled to the cylinder 13.

This pressing plate 15 is made to contact around an inner circumference of the waste transfer tube 11 for reciprocating movement inside of the waste transfer tube 11 according to reciprocating movement of the cylinder rod 14.

In addition, the other end of the waste transfer tube 11 is connected to one end of a guide pipe 16 for guiding transfer of the waste in the waste transfer tube 11 to the waste feeding objective place.

Dry distillation incineration devices 2 are installed in parallel spaced relationship a predetermined distance apart for carrying out dry distillation incineration of the waste fed into the sealed furnaces by the waste feeding devices 1, each including a dry distillation furnace 21 formed of a cylindrical vessel 22 having an inside lined with fire brick 23 and a top cap 22*a* connected to the top of the other end of the guide pipe 16.

Figure 3:
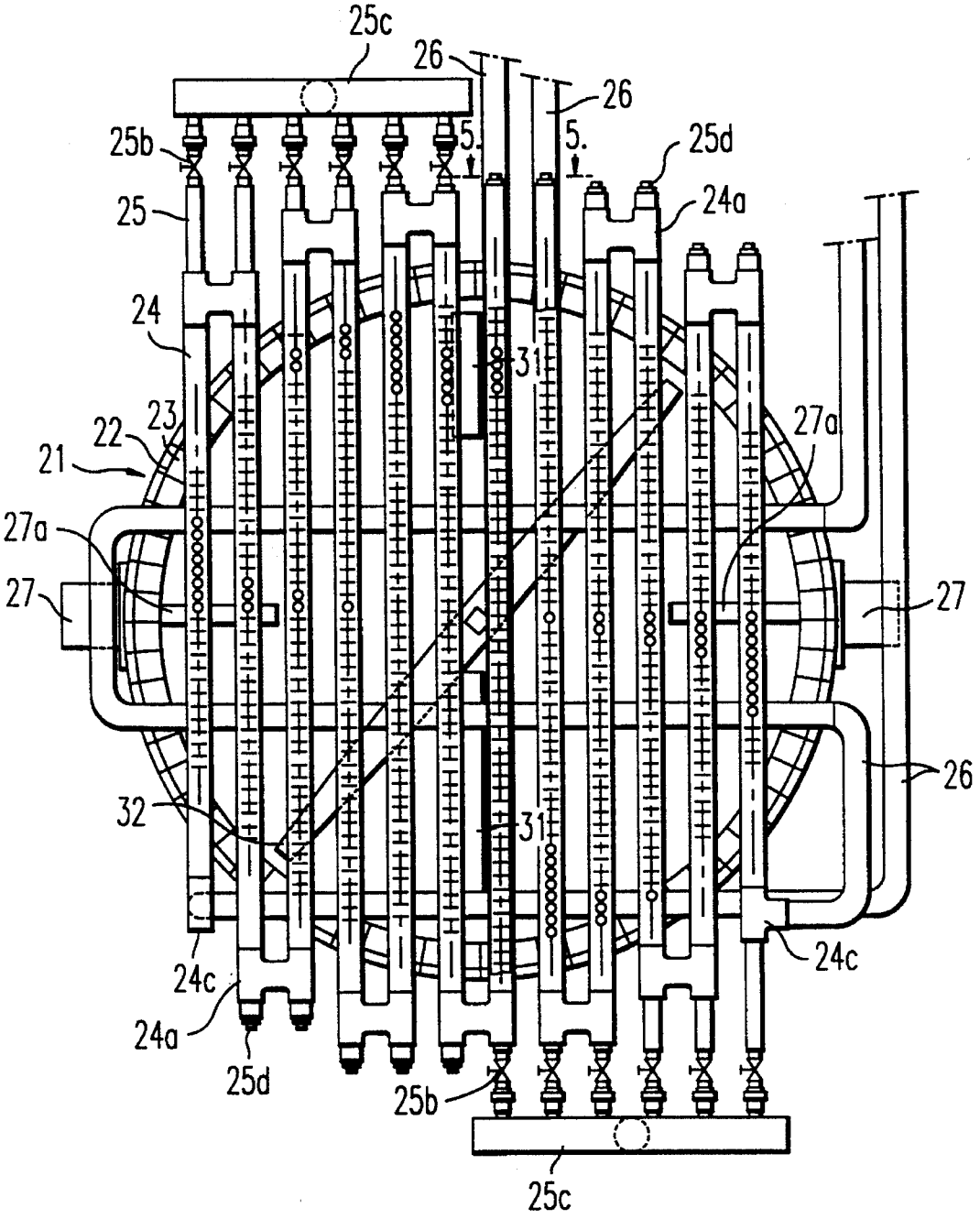
FIG. 3 is a section across line 3—3 of FIG. 1.

In addition, as shown in FIG. 3, at a lower side near the bottom of each of the dry distillation incineration furnaces 21, cooling water pipes 24 each having an concentric air pipe 25 inserted therein are installed spaced in a certain interval connected in series with connection pieces 24*a* for preventing thermal deformation of the air pipes 25.

Figure 4:
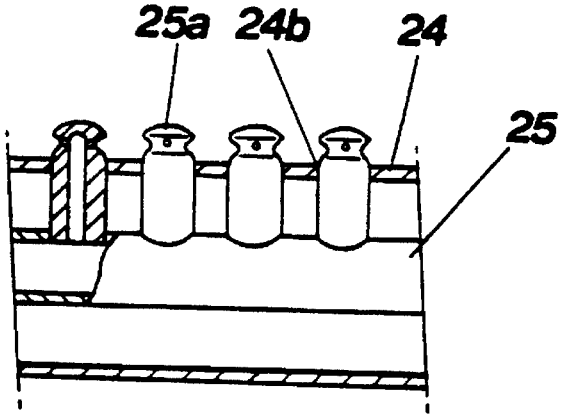
FIG. 4 is an partially enlarged section showing the joint of an air pipe and a cooling water pipe in accordance with this invention.

As shown in FIG. 4, nozzles 25*a* closely spaced in a certain interval fixed on top of the air pipes 25 are projected above the cooling water pipes 24 through nozzle holes 24*b* formed on top of the cooling water pipes 24, and each of the air pipes 25 has both ends projected from the ends of respective connection pieces 24*a* of which one end is connected to a manifold 25*c* having other air pipes also connected thereto with a shut off valve positioned in between for connecting to a blower (not shown), and the other end plugged with an end cap 25*d*.

There is also an end seal providing a seal between an end of an outer circumference of each air pipe 25 and an end of an inner circumference of the opposite connection piece 24*a*.

Figure 5:
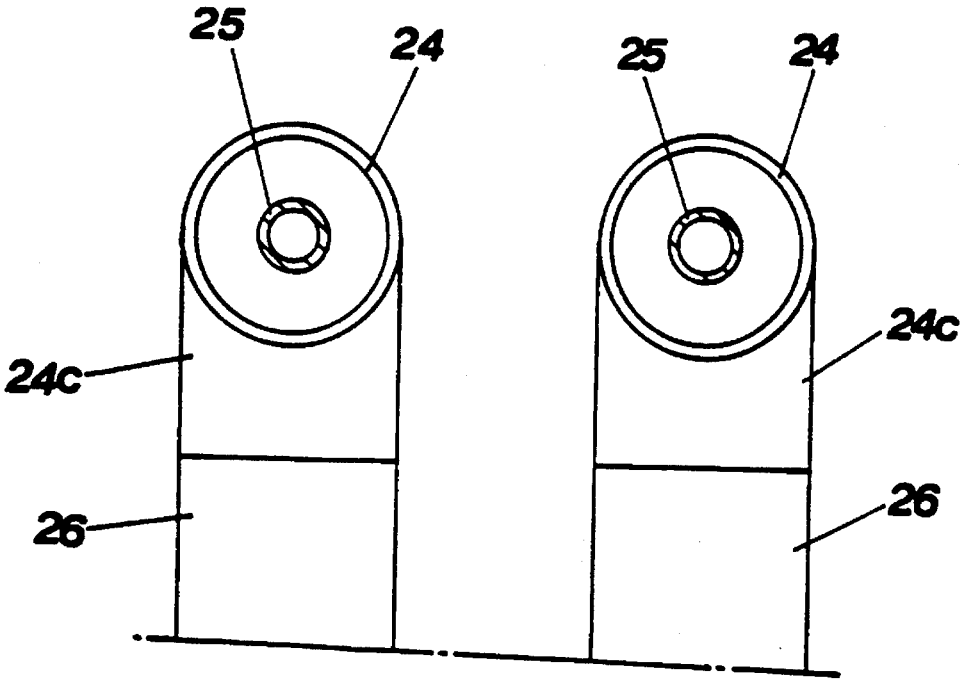
FIG. 5 is an enlarged section across line 5—5 of FIG. 3.

The ends of the cooling water pipes 24 having two lines in the middle and one line at each side (see FIG. 5) are connected to a water collection tank WT through a main cooling water pipe 26, and a pump P is installed on each of the two main cooling water pipes 26 connected either to the cooling water pipes 24 in the middle or one line at each side.

Thus, cooling efficiency of the dry distillation incineration furnace 21 can be improved because the circulation area of cooling water is divided into two parts for an internal sectional area of the dry distillation incineration furnace 21.

A burner 27 installed on an outer side of a lower side of each of the dry distillation incineration furnace 21 is connected to a flame injection pipe 27*a* which is extended into the dry distillation incineration furnace 21.

Each of the dry distillation incineration devices 2 is supported by a supporting frame 28 having vertical columns 28*a* and transverse beams 28*b* connected to form a hexahedral frame.

Figure 6:
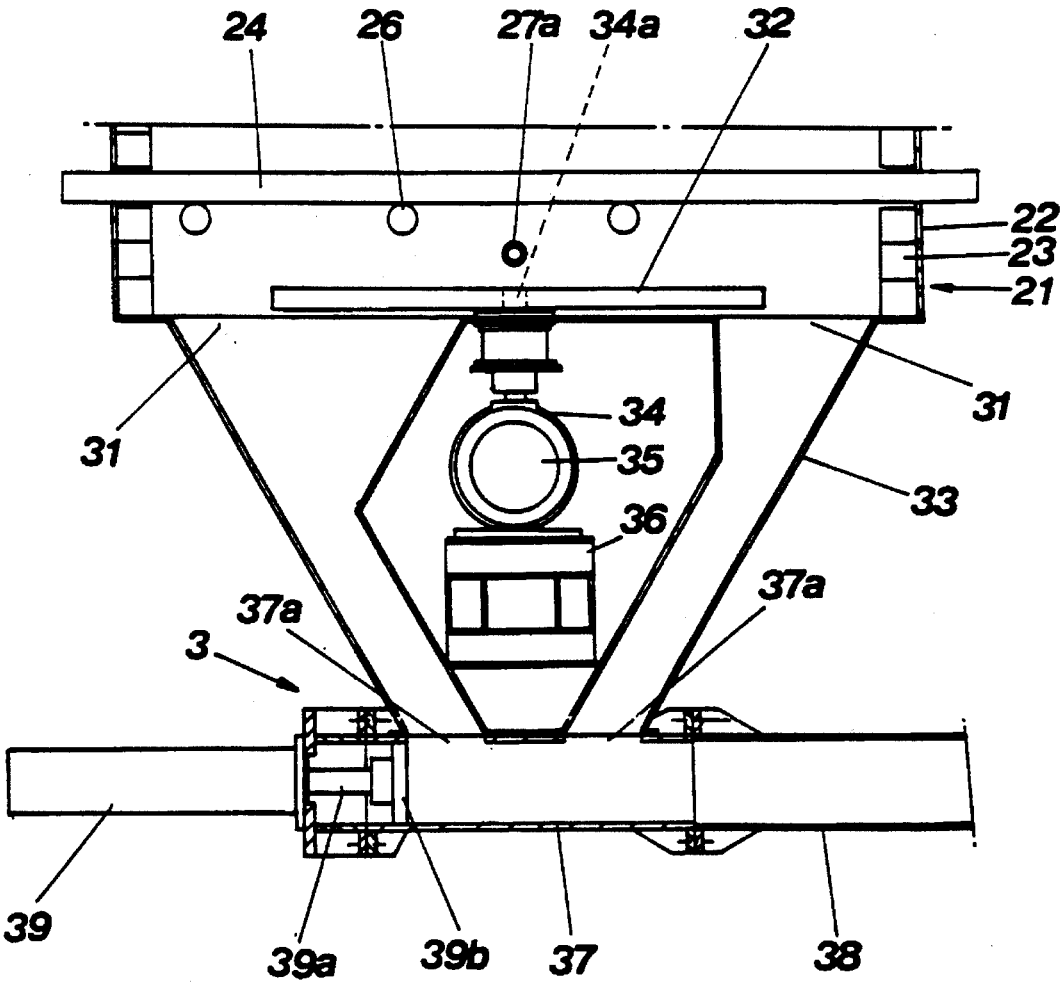
FIG. 6 is a section of an ash discharge device in accordance with this invention.

Reference number 3 indicates ash discharge devices for discharging ash produced in the dry distillation incineration furnaces 21 each including, as shown in FIG. 6, discharge openings 31 having a discharge blade 32 above it and each opened to one end of a "V" type discharge guide chute 33.

The discharge blade 32 is connected to an output shaft 34*a* of a reduction gear 34 connected to a motor 35 supported on a supporting frame 36 on a discharge guide chute body 34.

Lower ends of the discharge guide chute 33 are connected to ash drop openings 37*a* formed on top of a cylindrical ash transfer tube 37 of which one end is connected to an ash tank (not shown) through a guide pipe 38 and the other end is provided with a cylinder 39.

And a pressing plate 39*b* fixed to a fore end of a piston rod 39*a* coupled with the cylinder 39 is made to contact with the ash transfer tube 37 around the outer circumference thereof.

Reference numbers 4 indicate dry distilled gas combustion devices for burning the dry distilled gas generated at the dry distillation incineration devices each including a preheat ignitor 41 for preheat igniting the dry distilled gas, and a combustion tank 42 for burning the dry distilled gas preheat ignited at the preheat ignitor 41 within a predetermined space.

Each of the preheat ignitors 41 includes a body 41*a* having one side thereof connected to inside of a upper part of the dry distillation incineration furnace 21 via a dry distilled gas pipe 41*e* with a shut off valve and a gun burner 41*b* thereon and connected to an air pipe 41*c* for connecting an internal space thereof to a blower (not shown), and the other side thereof connected to an inlet of the combustion tank 42.

Figure 7:
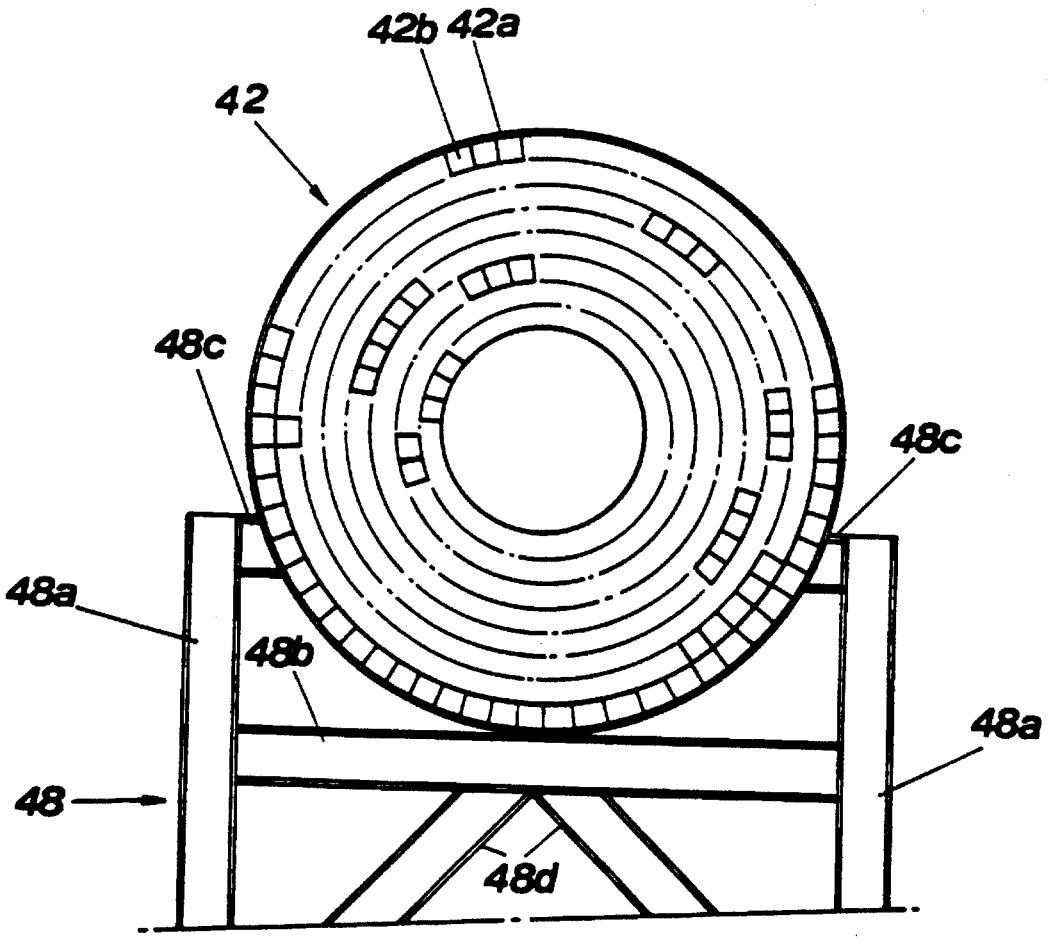
FIG. 7 is an enlarged section across line 7—7 of FIG. 2.

As shown in FIG. 7, each of the cylindrical combustion tank 42 includes a long cylinder 42*a* with the inlet side and the outlet side closed with cones, and fire brick lining 42*b* on inside surface thereof, and a common return pipe 43 connecting the two tanks 42 having a pressure reducing tank 44 with a diameter greater than the return pipe 43 and a shut off valve 45 at one end thereof.

The dry distilled gas combustion devices 4 are supported on a supporting frame 46 having a lower supporting frame 47 and a upper supporting frame 48 laid on the lower supporting frame 47.

The lower supporting frame 47 has vertical columns 47, transverse beams 47*b*, and longitudinal beams (not shown) jointed to form a hexahedral frame, and, as shown in FIG. 7, the upper supporting frame 48 has vertical columns 48*a*, transverse beams 48*b* and 48*c*, and sloped supports to form an M shaped frame.

Each of the combustion tanks 42 is placed on and fixed to the upper supporting frame 48.

Reference numbers 5 denote indirect dry distillation incineration tanks accommodated in the combustion tank 42 of the dry distilled gas combustion devices 4 for carrying out indirect dry distillation incineration of specific waste having high moisture content and waste wire, and each includes an outer shell 51 and an inner shell 52 put in the outer shell with a predetermined gap inbetween, and a rim plate 52*a* of the inner shell 52 placed on a rim plate 51*a* of the outer shell 51 is covered with a cover 53 detachably fixed on the rim plate 52 of the inner shell 52.

The reason that each of the indirect dry distillation incineration tanks 5 are provided with double structure of the outer shell 51 and the inner shell 52 is to prevent the inner shells 52 from performing transmission of excessive heat from the combustion tank 42 for slowly proceeding the dry distillation incineration process within the inner shell 52.

Meantime, two mounting openings 42*c* each with a size sufficient to insert the outer shell 51 are provided on the top of the combustion tank 5 for detachably putting each of the indirect dry distillation incineration tanks 5 into the combustion tank 42.

A supporting plate 58 jointed on both vertical supporting beams 56 jointed on upper side of the combustion tank 42 and shaped steels 57 jointed with vertical supporting beams 55 jointed on the vertical supporting columns 48*a* of the upper supporting frame 48, is provided for each of the indirect dry distillation incineration tanks 5 to support and detachably fix each of the rim plate 51*a* of the outer shells 51 of the indirect dry distillation incineration tanks 5 put through the mounting opening 42*c*, with clamps 59 and fasteners 59*a*.

Each of the indirect dry distillation incineration tanks 5 has a socket 6*a* with spectacle flanges 6*b* at both ends thereof for detachably connecting a connection pipe 6 connected to inside of the inner shell 52 to a common dry distilled gas pipe 7 led to the body 41*a* of the preheat ignitor 41.

Each of the combustion tank 42 of the dry distilled gas combustion devices 4 has the discharge side connected to a socket pipe 8 lined with fire brick connected to an inlet of known water cooled type heat exchanger 9.

Figure 10:
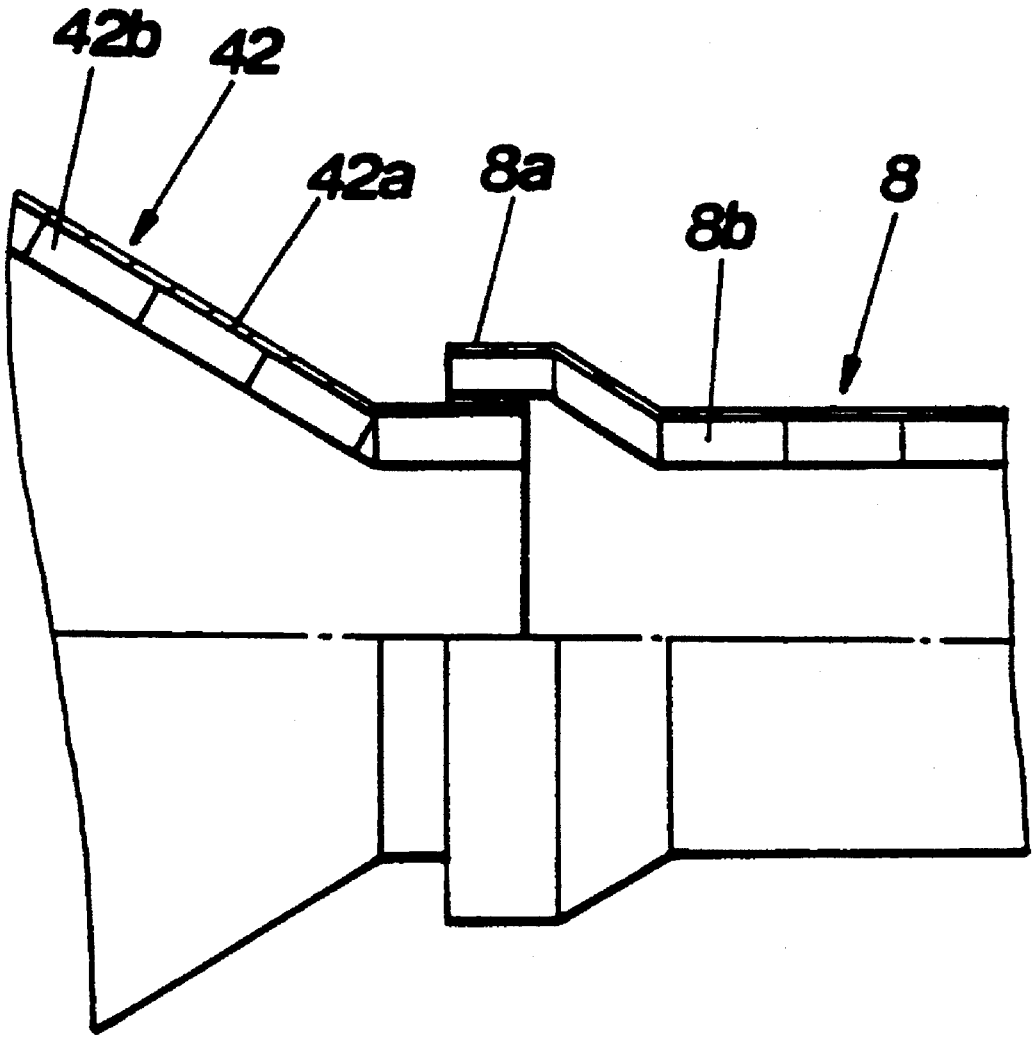
FIG. 10 is an enlarged semisectional view of "B" part of FIG. 1.

With regard to the connection of the discharge side, as shown in FIG. 10, a socket 8*a* of the socket pipe 8 is slidably coupled to an end of the combustion tank 42 to absorb thermal expansion of the combustion tank 42.

And each of the heat exchangers 9 has a cooling water side connected to a water collection tank WT through a cooling water pipe WT' for being supplied of cooling water and a gas discharge side connected to a chimney C through a discharge pipe M and a common manifold K, and a damper D is provided on one of the discharge pipe M. (the unexplained symbol MC is a manhole cover for a manhole for cleaning and maintenance of inside of the combustion tank 42).

Processes for incinerating waste using the incinerator in accordance with this invention having the foregoing construction is explained hereinafter. In explaining the processes, only one side of the incinerator is explained as far as they are identical.

First, waste is introduced into the waste transfer tube 11 through the hopper 12 of the waste feeding device 1 and the cylinder 13 is hydraulically pressurized to press the piston rod 14 together with the pressing plate 15 forward so that the waste in the waste transfer tube 11, pressed into the guide pipe 16, drops down from the upper end of the guide pipe 16 into the dry distillation incineration furnace 21 of the dry distillation incineration device 2 to heap the waste on the cooling water pipes 24.

When the waste is heaped to a predetermined amount on the cooling water pipes 24 by feeding of the waste into the dry distillation incineration furnace 21, feeding of waste is stopped, shut off valves 25*b* and 41*d* is opened, and the waste is heated with the burner 27 while the pump P and the blower (not shown) are driven to circulate cooling water through the cooling water pipes 24 as well as to supply air into the dry distillation incineration furnace 21 at a rate to burn the waste without making flame.

When the distilled gas generated from the heated waste in the dry distillation incineration furnace 21 starts to flow into the combustion tank 42 of the combustion device 4, the distilled gas is ignited by the gun burner 41*b* to burn the distilled gas in the combustion tank 42 while supplying air into the body 41*a*.

Once the distilled gas flowing into the combustion tank 42 is ignited, the following distilled gas flowing into the combustion tank 42 is also ignited to burn in the combustion tank 42, and the combustion gas generated in the combustion tank 42 is passed through the socket pipe 8, cooled down while flowing through the heat exchanger 9, and discharged through the chimney C via the discharge pipe M and the common manifold K.

Even though the combustion tank 42 is thermally expanded by the heat of combustion of the distilled gas in the combustion tank 42, no damage to the longitudinal connection of the combustion tank 42 can arise because of the slidable connection between the socket 8*a* of the socket part 8 and the discharge side of the combustion tank 42.

Meanwhile, in the foregoing incineration processes, the dry distillation incineration operation can be performed continuously simply by discharging ash heaped on a bottom of the dry distillation incineration furnace 21 and feeding new wastes into the dry distillation incineration furnace 21 each predetermined time, which periods of feeding of the waste and discharge of the ash are determined considering the incineration capacity of the dry distillation incineration furnace 21 and the amount of the discharged ash.

Feeding of waste can be carried out by the method that has been described already, and discharge of ash can be carried out by driving the motor 35 and pressurizing the cylinder 39 with hydraulic oil, of the ash discharge device 3 of FIG. 6.

Processes for discharging the ash are explained hereinafter in detail.

First, on driving the motor 35, the discharge blade 32 rotates scraping the bottom of the dry distillation incineration furnace 21 for the ash to drop into the ash placing tube 37 through the discharge openings 31 and the discharge guide chutes 33.

Accordingly, the ash thus dropped into the ash placing tube 37 is discharged into the ash tank (not shown) through the guide pipe 38 by reciprocation of the pressing plate 39*b* within the ash placing tube 37 upon pressurizing the cylinder 39.

Operation for incinerating specific wastes having a high moisture content or waste wire using the indirect dry distillation incineration tank 5 is explained hereinafter.

Figure 8:
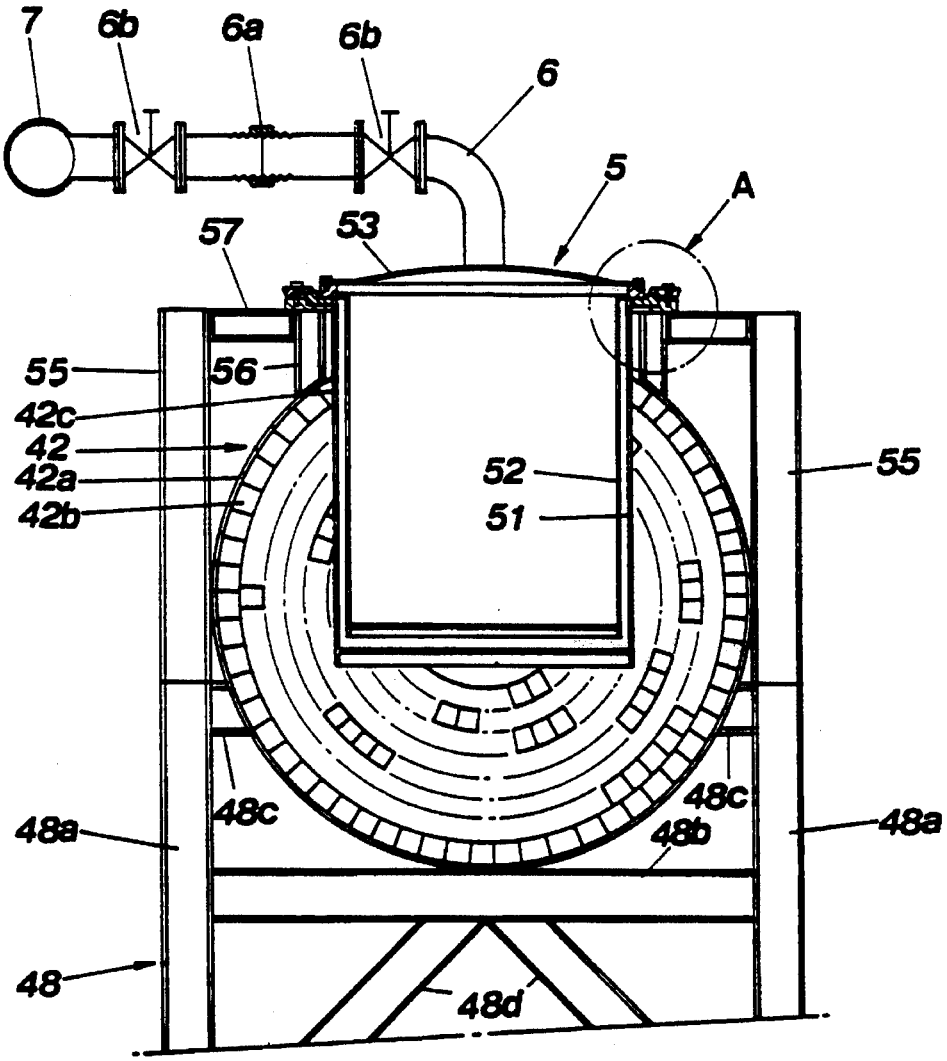
FIG. 8 is an enlarged section across line 8—8 of FIG. 2.
Figure 9:
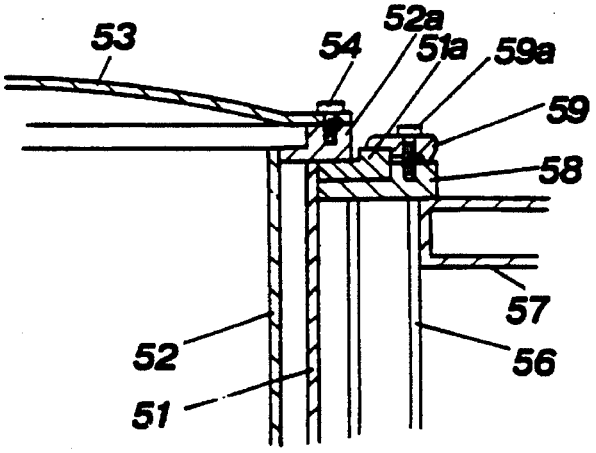
FIG. 9 is an enlarged view of "A" part of FIG. 8.

Referring to FIG. 8, upon conducting dry distillation in the dry distillation incineration furnace 21 as well as combustion in the combustion tank 42 under a condition that incineration objective waste has been put into the inner shell 52, the cover 53 has been closed on the inner shell 52, and the socket 6*a* has been screwed to connect the connection pipe 6 after the connection pipe 6 has been separated by unscrewing the socket 6*a* in one direction and the cover 53 has been separated by unscrewing the fasteners 54, the waste in the inner shell 52 is dry distilled by the combustion heat of the distilled gas burned in the combustion tank 42.

In addition, the dry distilled gas generated at dry distillation of the waste in the inner shell 52 flows into the combustion tank 42 through the connection pipe 6, the distilled gas pipe 7, and the body 41*a*, and is burned together with the distilled gas coming from the dry distillation incineration furnace 21.

Therefore, in the case where the waste is dry distillation incinerated with the foregoing processes, an effective incineration of high moisture content waste is possible since the waste is incinerated by thermal decomposition after the moisture of the waste has been vaporized, and particularly, in case waste wire is burned, copper of good quality can be obtained.

Moreover, in the present invention described above, in case one side of the discharge pipe M is closed with the damper D provided in the discharge pipe M, since the distilled gas incompletely burned in the one side combustion tank 42 can be made to flow to the other side combustion tank 42 through the return pipe 43 and to be burned further therein, the distilled gas can be burned completely.

In addition to the advantages of the conventional dry distillation incineration furnace, this invention described above has the further advantage of facilitating carrying out an effective incineration of a great quantity of waste in a short period of time because continuous operation of the incineration device is made possible by the continuous feeding of incineration objective waste and the automatic discharging of the ash produced in the dry distillation incineration furnace while the sealed condition of the dry distillation incineration furnace is maintained.

Moreover since this invention is provided to carry out incineration through dry thermal decomposition of the waste of high moisture content using the combustion heat of the dry distilled gas in the combustion tank, not only waste of high moisture content can be incinerated effectively, but also good quality copper can be recovered in case waste wire is incinerated.

Further, since this invention is provided to carry out a complete burning of the dry distilled gas incompletely burned in the combustion tank by burning it again, it is possible to prevent secondary pollution by the production of pollutants, such as soot and smelly gases.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. An incinerator for carrying out continuous dry distillation of waste, comprising:

a waste feeding device press feeding waste introduced into a waste transfer tube by repeatedly pressing the waste;

a dry distillation incinerator device having a sealed furnace receiving said waste from said waste sealed device and carrying out dry distillation incineration of the waste fed into the sealed furnace by supplying a predetermined amount of heat and air to the waste; and an ash discharge device discharging ash from the waste incinerated in the furnace wherein said furnace includes an array of air pipes, an array of water pipes and a burner.

2. The incinerator as claimed in claim 1, wherein the waste feeding device includes, a pressing plate positioned in the waste transfer tube, said transfer tube having a waste introduction opening and said pressing plate being driven by hydraulic pressure, and a guide pipe connected to one end of the waste transfer tube, wherein the waste introduced into the waste transfer tube is repeatedly pressed through the guide pipe by the pressing plate.

3. The incinerator as claimed in claim 1, wherein the ash discharge device includes, a discharge blade positioned on a bottom of the furnace and a motor which drives the discharge blade, an ash transfer tube positioned on lower side of the furnace and having an internal space connected to lower end of a discharge hole formed in the bottom of the furnace, and a pressing plate positioned inside the ash transfer tube for being reciprocated by hydraulic pressure.

4. The incinerator as claimed in claim 1, wherein a top portion of the furnace is connected to a dry distilled gas combustion device, said dry distilled gas combustion device including a preheat ignitor for preheat igniting the gas dry distilled by the furnace, and a combustion tank burning the dry distilled gas ignited by the preheat ignitor within a predetermined space and discharging the combustion gas.

5. The incinerator as claimed in claim 4, wherein the dry distilled gas combustion device includes a plurality of combustion tanks, each tank having a discharge side thereof connected to an adjacent inlet side thereof so that the distilled gas is discharged after being burned in multiple stages.

6. The incinerator as claimed in claim 4, wherein the preheat ignitor includes a body having a first end thereof connected to the top of the dry distillation incineration furnace and a second end thereof connected to an inlet side of the combustion tank, and a gun burner igniting the distilled gas flowing into the combustion tank.

7. The incinerator as claimed in claim 6, wherein the body is provided with an air supply.

8. The incinerator as claimed in claim 4 which comprises a heat exchanger wherein the discharge side of the combustion tank is connected to said heat exchanger so that the combustion gas discharged from the combustion tank is discharged after being cooled.

9. The incinerator as claimed in claim 8, which comprises a socket pipe having a socket part wherein the discharge side of the combustion tank and the heat exchanger are connected with said socket pipe, and wherein the discharge side of he combustion tank is slidably coupled with the socket part of the socket pipe.

10. An incinerator as claimed in claim 1, wherein said air pipes are positioned within said water pipes and said air pipes have nozzles which project from said water pipes.

11. The incinerator as claimed in claim 8, which comprises a heat exchanger wherein the discharge side of the combustion tank is connected to said heat exchanger so that the combustion gas discharged from the combustion tank is discharged after being cooled.

12. The incinerator as claimed in claim 11, which comprises a socket pipe having a socket part wherein the discharge size of the combustion gas and the heat exchanger are connected with said socket pipe and wherein the discharge side of the combustion tank is slidably coupled with the socket part of the socket pipe.

13. An incinerator for carrying out continuous dry distillation of waste, comprising:

a waste feeding device press feeding waste introduced into a waste transfer tube by repeatedly pressing the waste and including a guide pipe;

a dry distillation incinerator device having a sealed frame furnace receiving said waste from said waste feeding device and carrying out dry distillation incineration of the waste fed into the sealed furnace by supplying a predetermined amount of heat and air to the waste; and an ash discharge device discharging ash from the waste incinerated in the furnace wherein the sealed furnace has an inside surface lined with fire brick and a top part thereof is connected to the guide pipe, an array of air pipes arranged with certain intervals therebetween and positioned at a bottom inside portion of the furnace, said air pipes having nozzles arranged with a certain interval therebetween, an array of cooling water pipes positioned at the bottom inside portion of the furnace, and a burner positioned on a lower outer side portion of the furnace and a flame injection pipe which is connected to the burner and extends into the furnace.

14. The incinerator as claimed in claim 13, wherein the air pipes are respectively positioned in the cooling water pipe, and the nozzles are projected outwardly from the cooling water pipes.

15. The incinerator as claimed in claim 13, wherein a circulation area of cooling water circulated through the cooling water pipes is divided into two parts for an internal area of the furnace.

16. An incinerator for carrying out continuous dry distillation of waste, comprising:

a waste feeding device press feeding waste introduced into a waste transfer tube by repeatedly pressing the waste;

a dry distillation incinerator device having a sealed furnace receiving said waste from said waste feeding device and carrying out dry distillation incineration of the waste fed into the sealed furnace by supplying a predetermined amount of heat and air to the waste; and an ash discharge device discharging ash from the waste incinerated in the furnace wherein a top portion of the furnace is connected to a dry distilled gas combustion device, said dry distilled gas combustion device including a preheat ignitor for preheat igniting the dry distilled gas, and a combustion tank for burning the dry distilled gas ignited by the preheat ignitor within a predetermined space and discharging the combustion gas wherein the combustion tank detachably accommodates an indirect dry distillation incineration tank, said indirect dry distillation incineration tank having an inner shell placed in an outer shell with a predetermined gap formed there between.

17. The incinerator as claimed in claim 16, wherein inside of the inner shell of the indirect dry distillation incineration tank is connected to the inside of the combustion tank so that the distilled gas produced in the indirect dry distillation incineration tank can be burned and discharged.

18. An incinerator for carrying out continuous dry distillation of waste, comprising:

a waste feeding device press feeding waste introduced into a waste transfer tube by repeatedly pressing the waste;

a dry distillation incineration device having a sealed furnace carrying out dry distillation incineration of the waste fed into the sealed furnace by supplying a predetermined amount of heat and air to the waste; and an ash discharge device discharging ash from the waste incinerated in the dry distillation incineration device; and a dry distillation combustion device connected to the furnace, the dry distillation combustion device having a combustion tank including an inner and outer shell with a gap formed therebetween.

19. The incinerator as claimed in claim 18, wherein the dry distillation gas combustion device includes a preheat ignitor for preheat igniting gas which have been dry distilled by the furnace.

20. The incinerator as claimed in claim 19, wherein the dry distilled gas combustion device includes a plurality of combustion tanks, each of said tanks having a discharge side thereof connected to an adjacent inlet side thereof so that the distilled gas is discharged after being burned in multiple stages.

21. The incinerator as claimed in claim 19, wherein the preheat ignitor includes a body having a first end thereof connected to a top portion of the dry distillation incineration furnace and a second end thereof connected to an inlet side of the combustion tank, and a gun burner igniting the distilled gas flowing into the combustion tank.

22. The incinerator as claimed in claim 21, wherein the body is provided with an air supply.

* * * * *